US008056295B2

(12) United States Patent
Cappelle et al.

(10) Patent No.: US 8,056,295 B2
(45) Date of Patent: Nov. 15, 2011

(54) FLOOR COVERING, FLOOR PANEL AND METHOD FOR MANUFACTURING FLOOR PANELS

(75) Inventors: Mark Cappelle, Staden (BE); Bernard Thiers, Oostrozebeke (BE); Luc Vanhastel, Tielt (BE)

(73) Assignee: Flooring Industries Limited, SARL, Bertrange (LU)

( * ) Notice: Subject to any disclaimer, the term of this patent is extended or adjusted under 35 U.S.C. 154(b) by 345 days.

(21) Appl. No.: 12/087,665

(22) PCT Filed: Dec. 27, 2006

(86) PCT No.: PCT/IB2006/003808

§ 371 (c)(1),
(2), (4) Date: Jul. 11, 2008

(87) PCT Pub. No.: WO2007/080449

PCT Pub. Date: Jul. 19, 2007

(65) Prior Publication Data

US 2009/0000232 A1 Jan. 1, 2009

(30) Foreign Application Priority Data

Jan. 12, 2006 (BE) ..... 2006/0029

(51) Int. Cl.
*E04B 5/17* (2006.01)
*E04B 5/32* (2006.01)

(52) U.S. Cl. ..... 52/582.1; 52/588.1; 52/581; 52/589.1; 52/591.4; 52/586.1; 52/586.2

(58) Field of Classification Search ..... 52/384, 52/385, 390, 391, 392, 586.1, 586.2, 589.1, 52/591.4, 747.11, 747.1, 749.11, 591.1, 592.1, 588.1, 582.1, 590.1; 525/586.2
See application file for complete search history.

(56) References Cited

U.S. PATENT DOCUMENTS

| | | | | |
|---|---|---|---|---|
| 6,363,677 | B1 * | 4/2002 | Chen et al. | 52/586.1 |
| 2003/0205018 | A1 | 11/2003 | Bentham et al. | |
| 2004/0182036 | A1 * | 9/2004 | Sjoberg et al. | 52/592.1 |
| 2004/0187423 | A1 | 9/2004 | Weber | |
| 2005/0016107 | A1 * | 1/2005 | Rosenthal et al. | 52/578 |
| 2007/0059492 | A1 * | 3/2007 | Oldorff | 428/151 |

FOREIGN PATENT DOCUMENTS

| | | | |
|---|---|---|---|
| DE | 3343601 | A1 * | 6/1985 |
| DE | 101 42 298 | A1 | 9/2002 |
| DE | 202 19 110 | U1 | 3/2003 |
| DE | 203 19 121 | U1 | 6/2004 |
| EP | 1 359 265 | A | 11/2003 |
| FR | 2 716 690 | A1 | 9/1995 |
| WO | WO 2005/085550 | A | 9/2005 |
| WO | WO 2005/108710 | A | 11/2005 |
| WO | 03/087497 | A1 | 10/2009 |

* cited by examiner

*Primary Examiner* — Jeanette E. Chapman
(74) *Attorney, Agent, or Firm* — Bacon & Thomas, PLLC

(57) ABSTRACT

Floor covering, consisting of floor panels (2), which, at least at two opposite sides (3-4), comprise coupling parts (5-6), which, in the coupled condition of two of such floor panels (2), provide for a vertical as well as for a horizontal locking, characterized in that in coupled condition, at least at the location of the aforementioned two sides (3-4) of at least two mutually coupled floor panels (2), a strip (11), more particularly a prefabricated strip (11), is present in the floor covering (1), said strip extending up to the visible side of the floor covering (1).

22 Claims, 10 Drawing Sheets

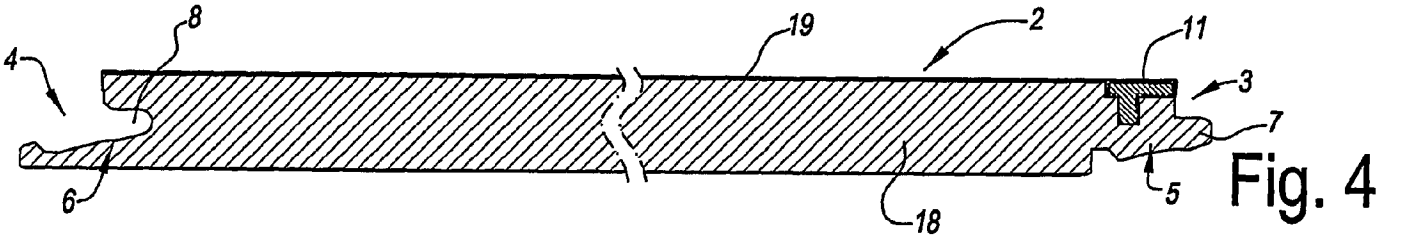
Fig. 4
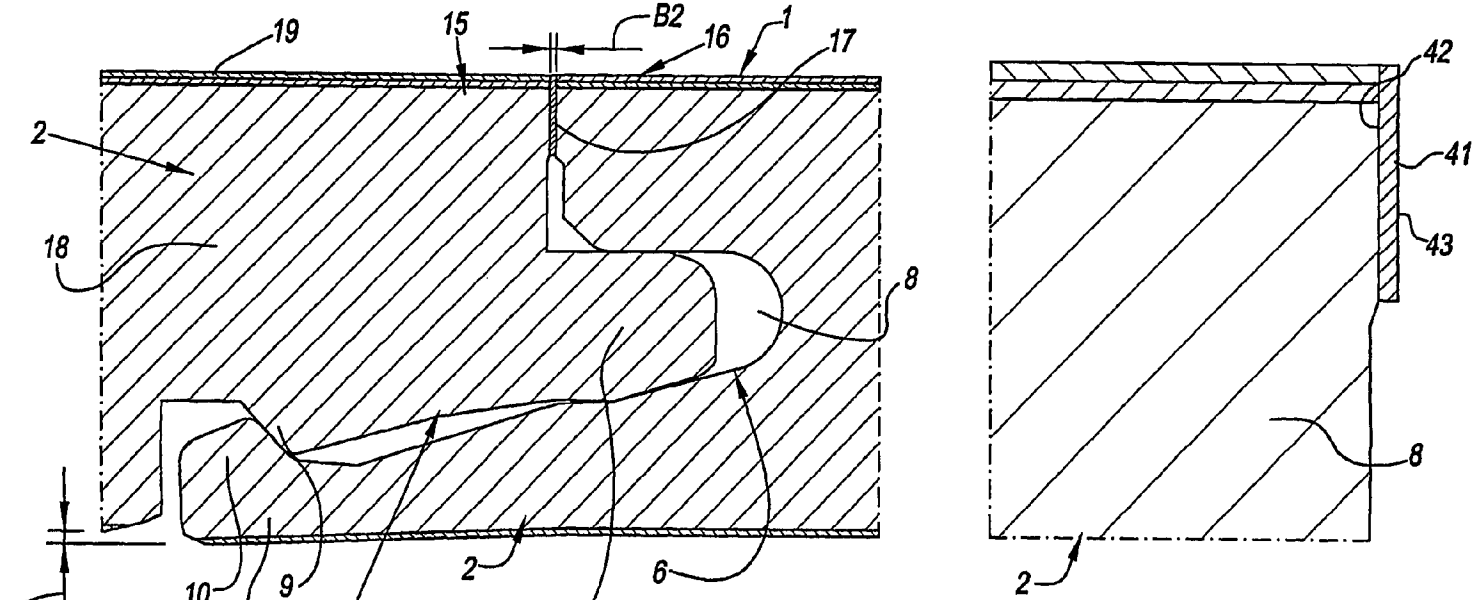
Fig. 6
Fig. 10

FLOOR COVERING, FLOOR PANEL AND METHOD FOR MANUFACTURING FLOOR PANELS

BACKGROUND OF THE INVENTION

A. Field of the Invention

This invention relates to floor coverings, to floor panels for realizing such floor coverings, as well as to methods for manufacturing floor panels and methods for realizing a floor covering from floor panels.

B. Related Art

More particularly, the invention relates to floor coverings that are composed of hard floor panels and wherein it is intended that this floor covering is floatingly installed.

In particular, the invention relates to laminate floor panels, which does not exclude that it can be applied for other types of floor panels, such as veneer parquet, prefabricated parquet, solid parquet and the like.

SUMMARY OF THE INVENTION

The invention aims at a floor covering with which at least one of the following two purposes is achieved, and preferably the combination thereof:

- the technical realization of a floor covering in which narrow visual separations are realized;
- providing an efficient technique for providing a seal, more particularly against penetration of water, between coupled floor panels.

In a particular application, a practical form of embodiment is aimed at, which offers a technical solution for imitating a ship floor, wherein preferably also a good sealing against penetration of water between the floor panels is guaranteed, in such a manner that such floor covering can not only be used in dry rooms, but also in wet or humid rooms, such as bathrooms, even if the core of the floor panels as such should be water-absorbing.

According to a first aspect, the invention to this aim provides a floor covering, consisting of floor panels, which, at least at two opposite sides, comprise coupling parts, which, in the coupled condition of two of such floor panels, provide for a vertical as well as for a horizontal locking, characterized in that in coupled condition, at least at the location of the aforementioned two sides of at least two mutually coupled floor panels, a strip, more particularly a prefabricated strip, is present in the floor covering, said strip extending up to the visible side of the floor covering and preferably extending into the proximity of the upper edges of the respective actual floor panels. In this manner, a simple coupling among the floor panels remains possible, whereas a separation still can be realized in a smooth manner.

Preferably, the aforementioned strip is realized as a seal against the penetration of moisture, more particularly water, between the actual floor panels. In this manner both aforementioned aims are realized, at least in relation to the edges of the floor panels where the strip is situated.

Further, it is preferred that the floor covering is characterized in that the floor panels are rectangular and that a seal is present at all four sides, thus, the sides extending in a first direction, as well as the sides extending in a second direction perpendicular to the first. In this manner, a sealing against water is offered along the entire contour of each floor panel.

Preferably, the strip consists of synthetic material or rubber. In a preferred form of embodiment, it is extruded.

Still better is it formed by co-extrusion of two or more materials, with the advantage that different properties can be created on different locations.

Preferably, the strip is formed by co-extrusion of two or more materials of different hardness.

Preferably, the floor covering further is characterized in that for the strip soft, harder, respectively, materials are applied, which are configured such that they form one or more of the following portions:

- one or more soft portions, which effect the sealing against the material of the actual floor panels;
- one or more soft portions, which create a matte appearance at the surface;
- one or more hard portions for attaching the strip in the respective floor panel;
- one or more hard portions, more particularly a core portion that is hard, in order to facilitate milling;
- a hard portion forming a core for the basic body of the strip and a soft portion that is made as a covering thereof, such that the lateral edges and the upper side of the strip consist of soft material.

Preferably, the floor covering is characterized in that at the respective sides between two adjacent floor panels one strip is present, wherein such strip then respectively is coupled to one of the adjacent floor panels and/or substantially is supported thereby, whereas, in the installed condition of the floor covering, it contacts the edge of the other floor panel. In this manner, a good support and positioning of the strip is always guaranteed.

According to another preferred characteristic, the coupling parts comprise a tongue and groove structure and the strip is provided at and/or attached to one side of the respective floor panels that is provided with the tongue. More particularly, it is preferred that the strip is supported directly or indirectly by the tongue. The integration of the strip at the tongue side offers the advantage that the material removal, which is necessary in order to provide space for the strip, has little or no influence on the strength of the coupling means.

Possibly, the strip may be applied for imparting special effects to the floor covering, for example, by making it fluorescent, by incorporating lighting elements therein, and so on.

According to a possibility of the invention, the strip consists of an element, which, when installing a floor covering, when mutually coupling a number of the floor panels, is taken up between these floor panels and is locked, wherein the floor panels preferably have well-defined lengths, whereas the strip preferably extends continuously over a larger length. This possibility of the invention offers the advantage that the manufacturer does not have to provide a special assembly unit in order to provide the respective floor panels with a strip. Moreover, the possibility exists of offering different embodiments of strips, for example, in different colors, wherein then different possibilities to choose from are available when installing a floor covering.

According to another possibility, the strip consists of a prefabricated element, which has been fixedly connected to the floor panels already prior to the installation of the floor panels, wherein the strip then preferably has a length that corresponds to the length of such floor panel. In this embodiment, then, the advantage is obtained that the user or installer himself no longer has to mount separate strips.

According to a second independent aspect, the invention relates to a floor covering, consisting of floor panels, which, at least at two opposite sides, comprise coupling parts, which, in the coupled condition of two of such floor panels, provide for a vertical as well as horizontal locking, characterized in that in coupled condition at least at the location of the aforementioned two sides of at least two mutually coupled floor panels a seal against penetration of water is provided, which seal is situated in the proximity of the upper side of the floor panels and which consists of a transfer material, in other words, a material that is provided on the respective edge of at least one of the respective floor panels by means of a transfer procedure. Such transfer material allows to realize an efficient sealing in a smooth manner, even with a very small thickness. Also, the application technique is practical and efficient.

Further, the invention also relates to floor panels for realizing floor coverings according to the first and second aspect, as well as to methods for manufacturing them and methods for realizing the floor coverings of such floor panels.

More particularly, the invention, amongst others, also relates to a method for manufacturing a floor panel, wherein this floor panel is rectangular, either oblong or square, and is of the type comprising a factory-applied strip, with the characteristic that herein, one starts with a panel; that at two opposite sides coupling parts or at least portions thereof are formed; that at one of these sides a strip, as aforementioned, is provided; and that only after these steps, coupling parts are formed on the other two sides. This technique has the advantage that, when the coupling parts on the aforementioned other two sides are formed by one or more machining treatments, these treatments can be performed continuously through the material of the floor panel itself as well as of the strip, as a consequence of which the strip obtains precisely the same length as the floor panel.

In the case that a separate strip is used, preferably a method is applied, which is characterized in that it comprises at least the following steps:

providing floor panels;

providing said strip in the form of a separate element;

installing a row of floor panels; and installing a subsequent row of floor panels by means of floor panels that are coupled to the floor panels of the first-mentioned row, wherein the aforementioned strip is mounted between both rows of floor panels.

Herein, it is preferred that for the strip, use is made of a tape, which extends over a length that is larger than the length of a floor panel, and still better extends over the length of several floor panels. According to an alternative, use may also be made of strips of a shorter fixed length, for example, a length corresponding to the length of a floor panel.

According to a particular technique, the last-mentioned method is characterized in that use is made of floor panels, which, at least at their sides between the respective rows, are coupled together by means of coupling parts consisting of a tongue and a groove, as well as of locking parts providing for a horizontal locking; that the rows of floor panels are laid such that an installed row of floor panels are directed with the sides comprising a groove towards the preceding installed row, and with the sides comprising the tongue towards a row still to be laid; that, before installing a floor panel of a subsequent row, already the strip is provided on the tongue of one or more floor panels of the already installed row; and that only thereafter, the floor panel to be installed is provided with the associated groove over the tongue. Advantages hereof will become evident from the further description.

Still other characteristics of the invention, as well as subordinate characteristics will become evident from the further description and appended claims. All subordinate characteristics described hereafter are optional and, according to not-represented variants, do not have be present in combination with each other.

BRIEF DESCRIPTION OF THE DRAWINGS

With the intention of better showing the characteristics of the invention, hereafter, as an example without any limitative character, several preferred forms of embodiment are described, with reference to the accompanying drawings, wherein:

FIG. 4 in cross-section represents a floor panel as such from the floor covering of FIG. 1;

FIG. 6, at a larger scale, represents a cross-section according to line VI-VI in FIG. 1;

FIG. 10 represents an upper edge of a floor panel according to the invention;

DETAILED DESCRIPTION OF PREFERRED EMBODIMENTS OF THE INVENTION

Figure 1:
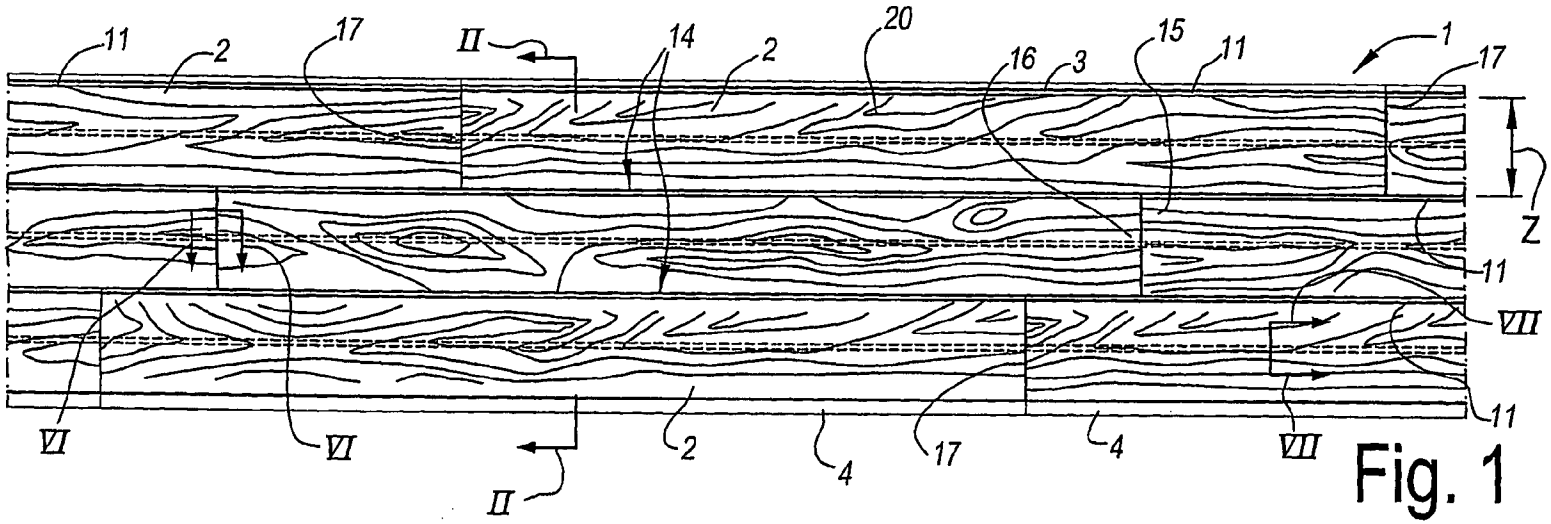
FIG. 1 in plan view represents a portion of a floor covering according to the invention.
Figure 2:
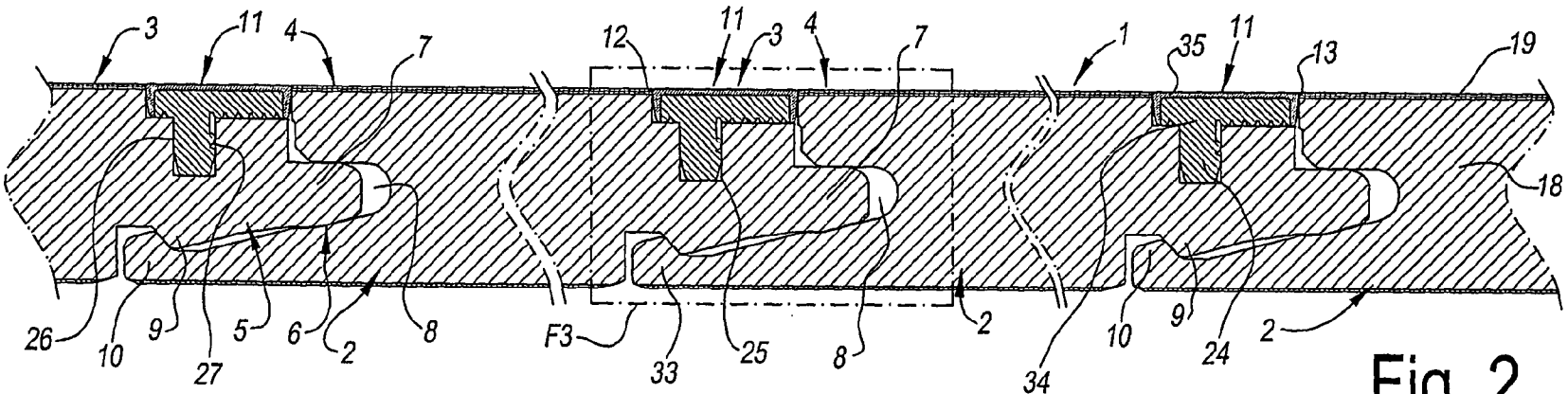
FIG. 2, at a larger scale, represents a cross-section according to line II-II in FIG. 1.

As represented in FIGS. 1 to 5, the invention relates to a floor covering 1 consisting of floor panels 2, which, at least at two opposite sides 3-4, comprise coupling parts 5-6 allowing to couple several of such floor panels to each other, wherein, in the coupled condition of two of such floor panels 2, a vertical as well as a horizontal locking is present, in other words, the floor panels are locked in mutual respect in the vertical direction R1 and the horizontal direction R2.

In the represented example, the coupling parts 5-6 consists of a tongue 7 and a groove 8 effecting the vertical locking, and locking parts 9 and 10 engaging behind each other and thereby effecting the horizontal locking.

The represented coupling parts 5-6 allow to join two of such floor panels by turning into each other as well as by snapping together. It is clear that other forms of coupling parts 5-6 are not excluded, said parts possibly allowing for other coupling techniques. Various forms of coupling parts are known extensively from the state of the art.

The floor covering 1 according to the invention is characterized in that, in coupled condition, at least at the location of the aforementioned two sides 3-4 of at least two mutually coupled floor panels 2, a strip 11, more particularly a prefabricated strip 11, is present in the floor covering 1, said strip extending up to the visible side of the floor covering 1, and preferably at least into the proximity of the upper edges 12-13 of the respective actual floor panels 2.

The strip 11 as such preferably is non-deformable, by which is meant that it shows, in cross-section, at least a certain non-deformability and thus, for example, does not consist of a very thin layer which, as such, would convolve in cross-section. More particularly, the strip has a profiled cross-section. However, preferably it does consist of a resilient bendable material.

Preferably, said strip 11 forms a seal 14 against penetration of moisture, more particularly water, between the actual floor panels. Such floor covering thus is particularly suitable for being installed in bathrooms. By a "seal" is meant that the penetration of water is entirely or almost entirely excluded, such that moisture can be present on the floor covering at least for a longer period of time without causing real damage.

In the represented example of FIGS. 1 to 6, the floor panels 2 are rectangular and oblong, and a seal 14-17 is present at all four sides, thus, the sides 3-4 extending in a first direction, in this case, the long sides, as well as the sides 15-16 extending in a second direction perpendicular to the first. Herein, the seal 14 consists of the aforementioned strip 11, which is visible more detailed in FIGS. 2 to 5, whereas the seal 17 can be obtained in any other manner. As represented in FIG. 6, the seal 17 preferably consists of a sealing matter, sealing layer or sealing tape provided between the actual floor panels 2, wherein this seal 17 has been provided on the floor panels 2 either by the user, or already at the factory.

In the example, the seal 14 has a larger visible width B1 at the sides 3-4 extending in the first direction, than the visible width B2 of the seal 17 at the sides extending in the second direction. Preferably, the width B2 preferably is as small as possible and equal to nothing or almost nothing. In this manner, a waterproof or almost waterproof floor covering can be created with the appearance of a ship floor, thus, globally seen, with alternating continuous lines of actual floor panels and intermediate strips.

In the case that the floor panels 2, as represented, are oblong and the seal 14 at the long sides 3-4 is formed by the aforementioned strips 11, it is preferred that such strips 11 have a visible width B1 of minimum 3 mm, whereas the seals 17 at the others sides 15-16 then have a visible width B2 that is smaller than 1 mm or is invisible.

As represented in the figures, the invention is particularly useful with laminate panels.

By making use of the strips 11, special effects can be created in a practical manner.

In the case that such strips are made as seals, moreover floors can be realized with a high resistance against penetration of water, as a consequence of which even laminate floor panels with a wood-based substrate or other floor panels with a substrate based on wood, at least when they have a suitable top layer, more particularly a waterproof top layer, such as a layer of synthetic material, resin, lacquer or the like, can be applied for wet rooms, such as bathrooms.

In the represented example, the floor panels 2 comprise a core 18 based on wood, for example, HDF or MDF, and a laminate top layer based on synthetic material, more particularly based on resin, such as DPL (Direct Pressure Laminate). In order to safeguard waterproofness and/or for optical reasons, the strip 11 adjoins up to the laminate top layer 15.

In the figures, the floor covering 1 is made as a ship floor or a so-called ship deck, wherein the actual floor panels 2 present between the strips 2 comprise a wood pattern 20, whereas the strips 11 themselves preferably have no pattern.

As also represented in the figures, it is preferred that at the sides 3-4 between two adjacent floor panels 2, seen in cross-section, solely one strip 11 is present each time, wherein such strip 11 each time is coupled to one of the adjacent floor panels 2, whereas, in the mounted condition of the floor covering 1, it comes into contact with the edge of the other floor panel 2.

In the represented example, the strip 11 shows a flat basic body 21 extending in substantially horizontal direction. This basic body has a support surface at the bottom, which, globally seen, preferably is flat, which does not exclude that such global flat support surface, as represented, as such can be provided with a relief.

Preferably, the thickness D is smaller than 2 mm. In this manner, the edge area of the actual panel is weakened as little as possible, which is important with mechanical coupling parts 5-6. Also, in this manner a rather wide strip 11 can easily be integrated into the edge of such floor panel 2.

The strip 11 is attached to the side 3 of each respective floor panel 2 that is provided with the tongue 7. Thereby, an optimum attachment is possible. According to the invention, however, an integration into the groove side of a floor panel is not excluded, however, this leads to an extensive weakening in the actual tongue and groove structure.

As represented, the strip 11 preferably is supported at least by a support surface 22, said surface being situated higher than the upper side 23 of the tongue 7. In this manner, a sufficient amount of basic material remains present below this support surface, for example, as described hereafter, for providing an attachment groove therein.

It is noted that the strip 11, as illustrated, preferably is situated outside of the contour of the inside of the groove 8 and the portion of the tongue 7 cooperating therewith, such that the vertical fit among tongue and groove can not be directly influenced by the material of the strip 11.

The strip 11 is provided with at least one attachment part 24 with which it is attached to an actual floor panel 2, in this case, an attachment groove 25 provided to this aim.

The attachment part 24 preferably provides at least for a lateral locking of the strip 11 in respect to the actual floor panel 2. As represented, this locking preferably is obtained by means of stop-forming means, in this case in that the side walls of the attachment part 24 contact the walls of the attachment groove 25. Further, it is preferred that in attached condition, there is at least a pressing towards to the own floor panel 2 as well as towards another adjacent floor panel, such because the strip 11 is configured such that, in mounted condition, it is clamped between both floor panels. Preferably, the strip 11 thus is at least somewhat elastic.

As represented, such strip 11 preferably is supported, by the actual floor panel 2 in which it is attached, up to the exterior edge or almost up to the exterior edge thereof.

In the represented form of embodiment, the attachment part 24 is made as a projection situated at the bottom side of the strip. This allows for an easy attachment.

Herein, the attachment part 24 is made as a rib, which can cooperate with the attachment groove 25 in an actual floor panel 2. In mounted condition, the attachment part herein rests against flanks 26-27 of the attachment groove 25.

As represented, it is preferred that coupling parts are applied that are made as a tongue and groove structure; that at the bottom side of the tongue 7 a locking part 9 in the form of a projection is present; and that the aforementioned attachment groove 25 is situated at least partially above this projection. In this way, the weakening of the material created by the presence of the attachment groove is more or less compensated by the material of the locking part 9.

In the represented embodiment, the strip 11 has a substantially T-shaped cross-section, formed by a flat basic body 21 and the attachment 24 provided at the bottom side.

In the example, the attachment part 24 is situated off the center M of the strip 11 and at a location P situated closer to the center of the respective floor panel 2. In this manner, a maximum of material may remain between the attachment groove 25 and the tip of the tongue 7, which is advantageous for the stability at the tongue side.

Preferably, the attachment part 24 fits in a clamping manner into the seat provided to this aim, in this case, thus, into the attachment groove 25. To this aim, compressible parts, such as the represented clamping ribs 28, may be formed at the attachment part 24. In the figures, the compression of the material of the strip substantially is not represented, however, it is clear that in practice such compression may be obtained by providing a suitable clamping fit at all locations where a clamping is desired.

According to a not represented variant, use may also be made of a snap connection.

Figure 3:
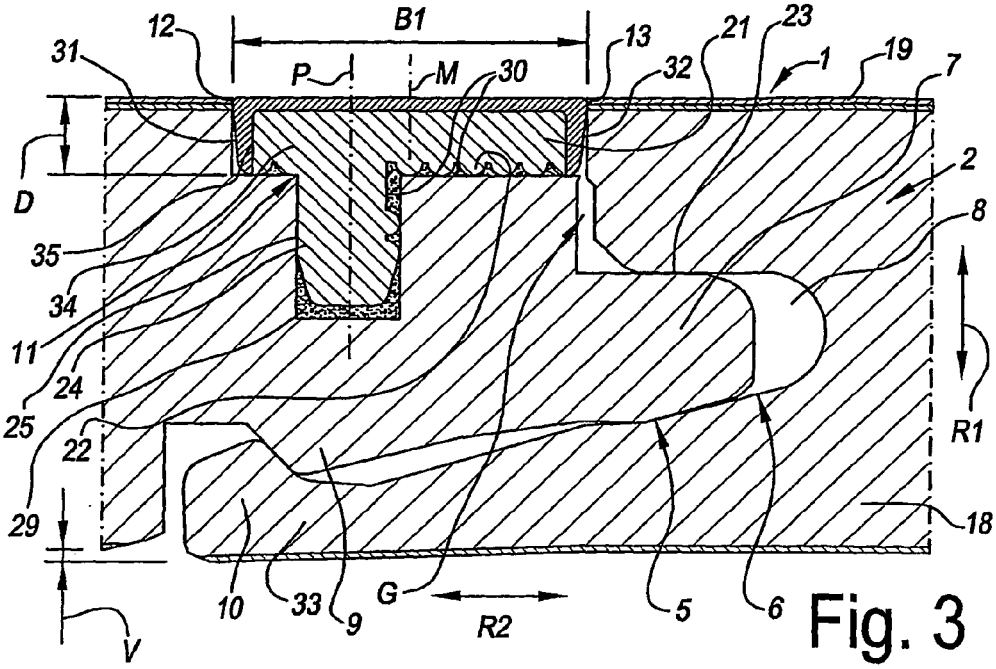
FIG. 3, at an even larger scale, represents the portion indicated by F3 in FIG. 2.

FIG. 3 clearly shows that use may also be made of glue 29. In order to prevent that all glue is pushed away, the strip 11 preferably is provided with glue grooves 30.

As represented, the strip 11 may have lateral edges 31-32, which, at least in free condition, are undercut, which facilitates the application of the strip 11 and guarantees a better sealing.

Figure 5:
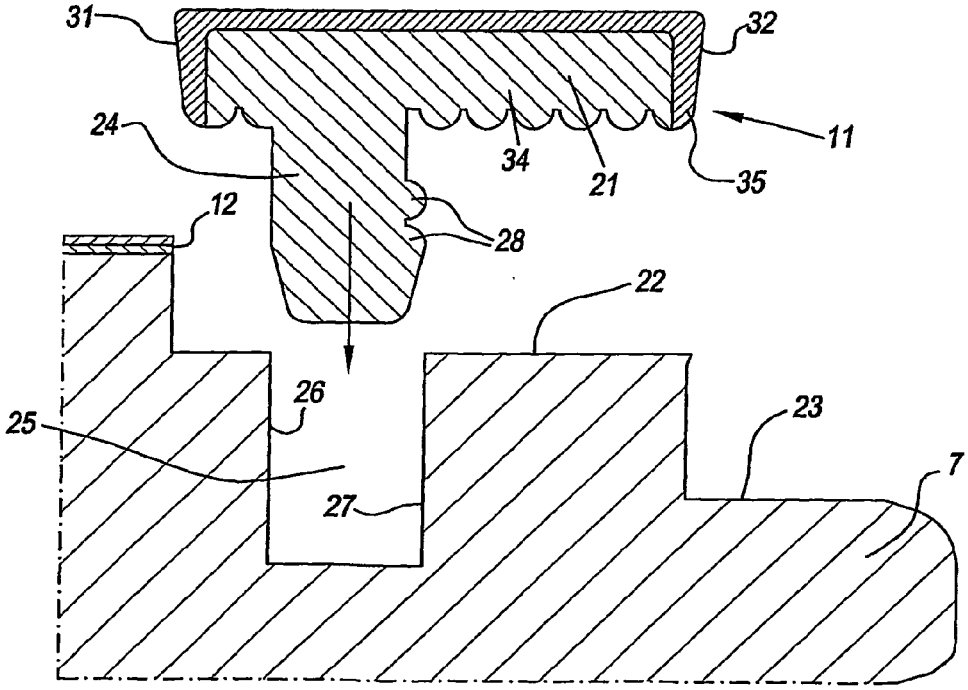
FIG. 5, at a highly enlarging scale, represents a portion from FIG. 4, prior to the attachment of the strip in the actual floor panel.

As is visible in FIG. 5, the strip 11 preferably can be inserted vertically.

As represented, the upper side of the strip 11 preferably is situated in the same or almost the same plane as the upper side of the actual floor panels. However, other embodiments are not excluded. So, for example, may the upper surface of the strip 11 be somewhat sunk and/or concave.

Preferably, the width B1 is situated between 2 mm and 20 mm, and still better between 3 mm and 10 mm.

Preferably, the visible width Z between the strips 11 is between 3 to 20 cm, and still better 7 to 15 cm. All combinations of values B1 with values Z are possible.

In general, it is preferred that the strip 11 is sitting clamped between both adjacent actual floor panels 2.

Further, it is also preferred that the floor panels 2, at least at the sides 3-4 where the strip 11 is present, are coupled to each other with a pretension and the coupling parts thus provide for that the coupled floor panels are drawn to each other with a tension force. Such pretension may be realized in different manners. In the example, to this aim use is made of the tension force provided by the lower lip, bent out elastically over a distance, in combination with the not explicitly depicted compression of the material of the strip 11.

In the represented example, the tension force of the pretension is taken up by means of the strip 11. However, it is clear that according to a not-represented form of embodiment, the tension force also might be taken up at least partially directly between the actual floor panels, for example, in that the actual panel material of both floor panels 2 would be resting against each other in the area G represented in FIG. 3.

Such "pretension" is a term that has become well-known in the meantime and is known from WO 97/47834.

Preferably, the strip 11 consists of synthetic material or rubber.

Preferably, the strip 11 is extruded. This allows for an accurate and inexpensive production.

In the example of FIGS. 1 to 5, the strip 11 is formed by the co-extrusion of two materials of different hardness, such that the strip 11 has a hard portion 34 and a soft portion 35. The hard portion 34 forms the core of the basic body 21 and the attachment part, too, whereas the soft portion 35 is made as a covering, such that the lateral edges and the upper side of the strip 11 consist of soft material. The soft material promotes the clamping and good adjoining and, thus, also the sealing. Moreover, with the soft material it becomes easier to give the strip 11 a matte appearance. The hard material provides for that a sturdy attachment part is obtained and, still more important, that the strip 11 becomes millable.

The strip may be made in different colors, however, preferably it is black.

Figure 7:
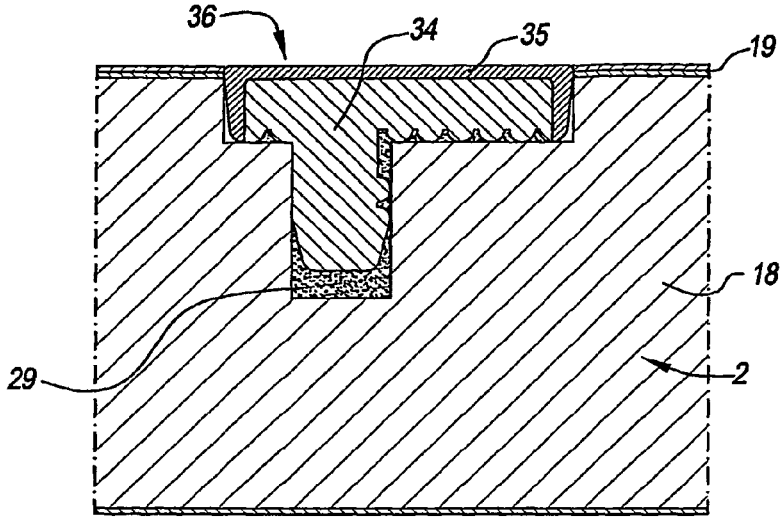
FIG. 7, for a possible variant, represents a cross-section according to line VII-VII in FIG. 1.

The variant represented in dashed line in FIG. 1, a cross-section of which is depicted in FIG. 7, shows that between the strips 11 also one or more intermediate strips 36 can be integrated into the actual floor panel in order to obtain a visual division and to limit the number of separate floor panels.

Figure 8:
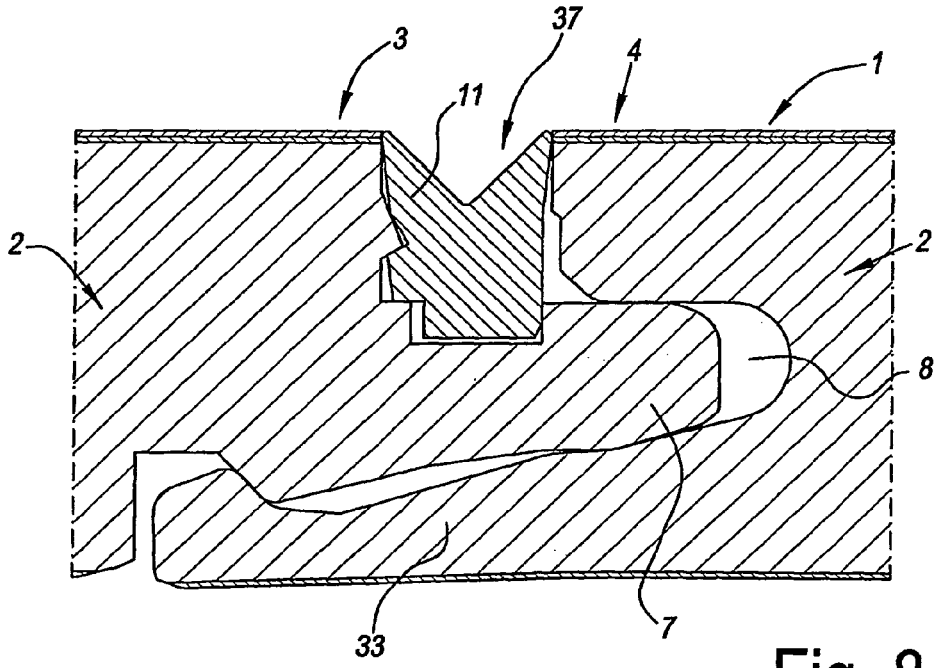
FIG. 8 represents a variant of the invention, in a view analogous to that of FIG. 3.

FIG. 8 represents a particular form of embodiment, wherein a chamfer structure 37 is integrated into the strip 11.

It is not excluded that the strip 11 consists of an insertable prefabricated element, which, when installing a floor, during or after coupling a number of the actual floor panels 2 to each other, is provided between these floor panels. The strips then either are taken up between the floor panels during the joining of floor panels, or are pressed on between the already installed actual floor panels and possible glued on or connected with the floor panels in another manner. The applied strips then may consist of continuously extending strips, for example, cut off from a roll.

It is, however, useful that the strip 11 consists of a prefabricated element, which has already been connected to the floor panels 2 prior to the installation of the floor panels 2, preferably fixedly connected, wherein this latter preferably has been performed at the factory. When installing a floor covering, thus, no separate operations have to be performed in order to provide the strip.

It is clear that the invention also relates to the floor panels 2 that are applied when composing the aforementioned floor covering. More particularly, this relates to a floor panel 1, which, as illustrated in FIG. 4, as such comprises a strip 11 attached therein, which has been provided at the factory. The strip 11 then has the same or approximately the same length as the floor panel.

The invention also relates to a method for manufacturing a floor panel according to the invention, more particularly a rectangular floor panel 2 comprising a strip 11, preferably a strip having one or more of the above-described characteristics. Herein, according to this method, one starts from a panel; coupling parts 5-6 or at least portions thereof are formed at two opposite sides of this panel; a strip 11, as aforementioned, is provided at one of these sides 3; and only after these steps coupling parts are formed at the other two sides 15-16.

Figure 9:
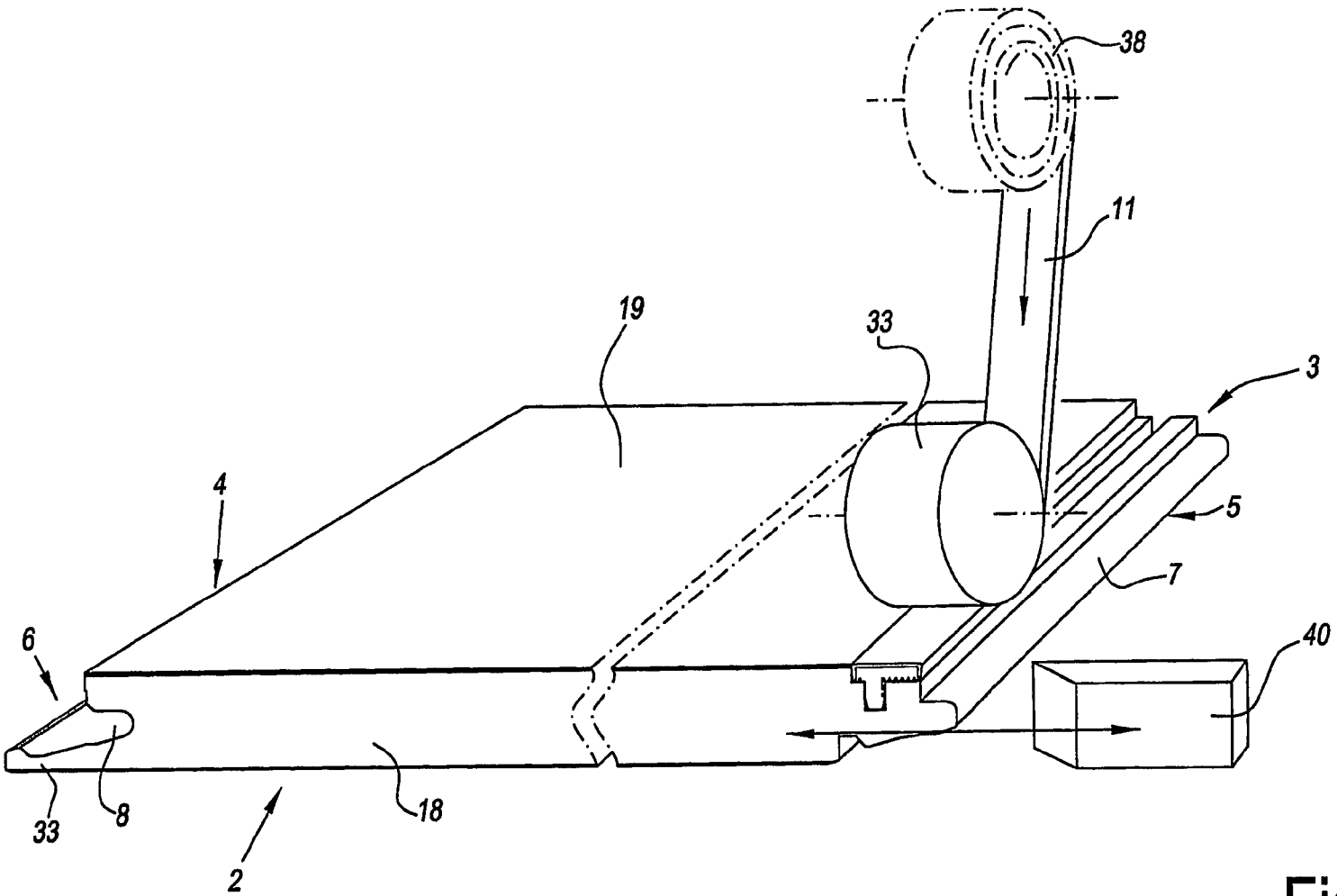
FIG. 9 schematically represents a method for manufacturing floor panels.

Preferably, herein use is made of a strip 11 that can be wound up, wherein the strip 11, during the manufacture of the floor panels, is systematically unwound. This is schematically shown in FIG. 9, wherein the strip 11 is fed from a supply roll 38 to passing panels and is pressed by means of a pressing roller into the profiled portion provided to this aim, and possible is glued on therein. The strip 11 is cut to length by means of a cutting device, which is schematically represented by a knife 40.

The not represented coupling parts at the sides 15-16 then can be formed in a usual manner, for example, by means of one or more milling treatments, which then simply are performed also perpendicularly through the extremities of the strip 11.

When the seal 17 of FIG. 7 is formed of a transfer material 41, in other words, a material that is provided on the respective edge of at least one of the respective floor panels 2 by means of a transfer procedure, as represented in detail in FIG. 10, FIG. 6 also forms an example of the independent second aspect of the invention mentioned in the introduction.

Preferably, such transfer material 41, at the location of two cooperating sides of adjacent floor panels 2, beforehand has been provided solely at the respective side of one of the floor panels, such that only one layer of transfer material 41 is inserted between two coupled sides.

As schematically represented in FIG. 10, the transfer material 41 consists of a strip-shaped substance with a side 42 adhering to the actual floor panel 2 and a side 43 facing away from the respective floor panel 2.

Several preferred possibilities of suitable transfer material 41 are:

- a strip-shaped substance sticking, at room temperature, at one side 42 and sticking less or not at all at the other side 43, wherein this substance, by means of the sticky side, adjoins to a floor panel 2, wherein for the sticky side preferably use is made of a pressure-sensitive glue present at this side;
- transfer material that is performed as a "heat transfer material", wherein, for example, a substance is applied that adheres in warm condition and adheres less when cooled down, or wherein at the side 42 heat-activatable glue, such as hot-melt glue, is used, whereas at the side 43 a not or hardly adhering component is present;
- transfer material that is formed of the same material as a correction tape (for example, correction tape available in commerce under the denomination "Pritt correct-it") or a material with comparable properties, whether or not transparent.

Preferably, the transfer material 41 is compressible, and such under the influence of the usual tension force that can be realized among floor panels. In uncompressed condition, the transfer material 41 preferably has a thickness of less than 0.1 mm when it is present on the floor panel.

According to a preferred form of embodiment, the transfer material 41 is clear transparent or has a color that is adapted to the appearance of the upper surface of the adjacent floor panels 2.

The transfer material 41 may be a material that is provided when installing the floor covering 1. The provision then possibly may take place by means of a manually operated application device, which possibly may be a device analogous to the devices known from the field of stationary, for example, as described in WO 02/083535.

According to another possibility, the transfer material 41 is a material that has been applied at the factory.

The invention also relates to a floor panel for realizing a floor panel according to the second aspect, characterized in that it comprises a factory-applied transfer material 41 at the location of one or more edges, which, when interconnecting several of such floor panels, forms a seal 17 against water.

Figure 11:
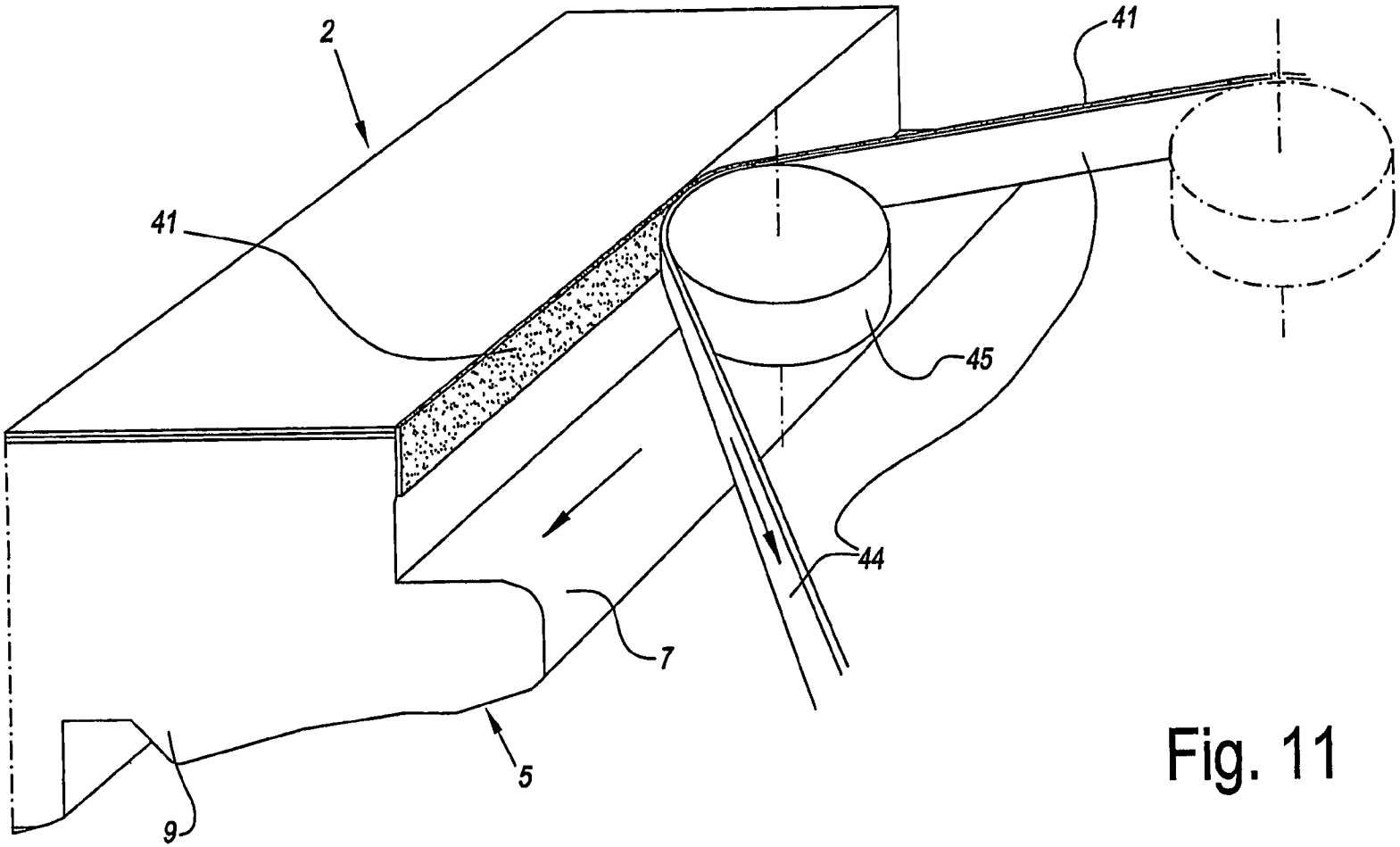
FIG. 11 schematically represents another method for manufacturing floor panels.

The invention also relates to a method for manufacturing such floor panels, characterized in that it comprises at least the steps of forming panels; providing, at least at two opposite sides, coupling parts 5-6, which, in the coupled condition of two of such floor panels 2, provide for a vertical as well as horizontal locking; and providing, at least at one of these sides, a sealing material by means of a transfer procedure. This method is schematically illustrated in FIG. 11, wherein on top of the coupling part 5, sealing transfer material 41 is provided on the edge of a floor panel 2 by means of a transfer procedure. The transfer material 41 is supplied on a carrier tape 44 and is transferred under the influence of pressure from a pressing means, in this case a roll 45, and possibly under the influence of heat.

By sealing transfer material, any material is understood which may be composed of several layers or not, which, when used between the floor panels, prevents all or almost all penetration of water, preferably even of water in which soap is dissolved.

In a practical embodiment, the transfer material is composed of at least a layer of adherence material and a layer of soft compressible material.

It is noted that in general it is useful that the strip 11 comprises attachment means by which such strip 11 is locked in vertical direction, thus, in such a manner that the strip is prevented to become dislodged from the plane of the floor covering. It is emphasized that these attachment means may be of any kind and that they are not limited to the manner of attachment by means of glue or by clamping solely by friction, as in FIG. 3. For example, these attachment means may be purely mechanical, and more particularly may be formed as stop-forming parts preventing that the strip can become dislodged from the plane of the floor covering.

According to a particular embodiment, these attachment means are provided so closely to the aforementioned sides of the actual floor panels, that the strip, by coupling two of such floor panels, is fixedly clamped between the actually floor panels.

Figure 12:
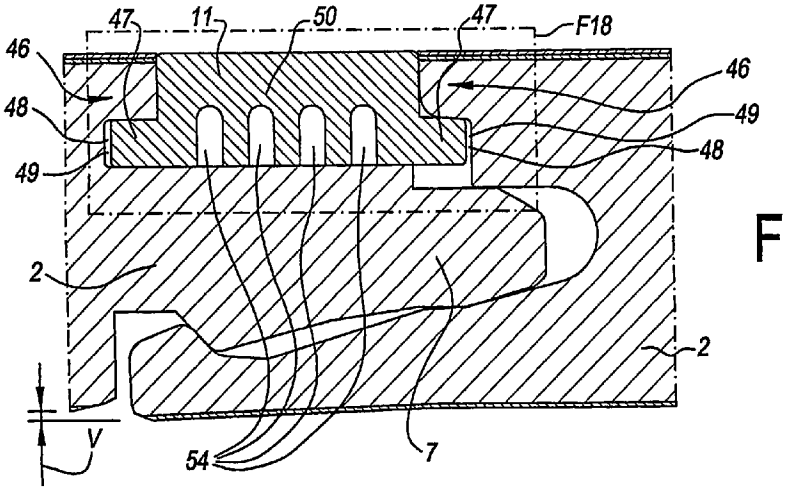
FIG. 12 in cross-section represents another variant of a portion of a floor covering according to the invention.

For illustrative purposes, FIG. 12 represents a form of embodiment in which the last-mentioned characteristics have been applied.

Herein, the attachment means 46 are of a purely mechanical kind and consist of stop-forming parts, which, in the example, at least consist of, on the one hand, lateral projections 47 formed at opposite sides of the strip 11, and, on the other hand, recesses 48 formed in the edges of the floor panels 2, said recesses forming respective seats for the aforementioned projections 47.

Herein, the attachment means 46 are formed in that the strip 11 has a reversed T-shaped cross-section and the projecting arms of the T-shape thereby function as said projections 47.

In the mounted condition of the strip 11, a free space 49 respectively is present between the distal extremities of the projections 47, whereas above the projections 47 a portion 50 of the strip 11 is situated, which portion, in mounted condition, is clamped between the edges of the actual floor panels 2.

It is clear that variants are possible, wherein the strip 11 is held by a projection 47 solely at one edge.

Figure 13:
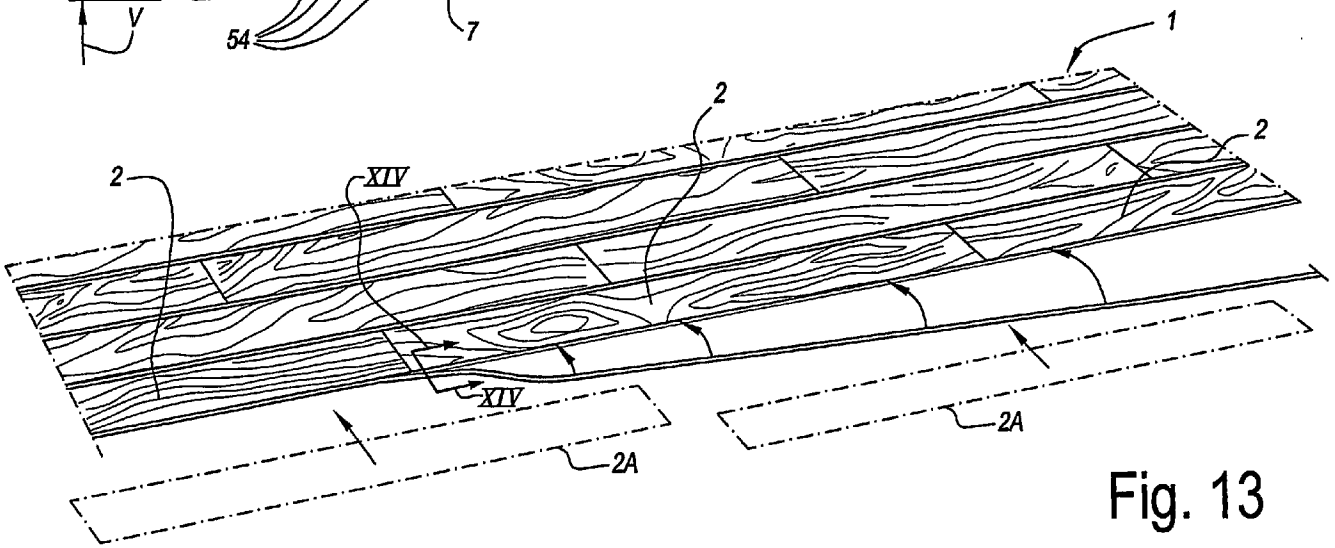
FIGS. 13 to 15 illustrate a method for installing a floor covering.
Figure 14:
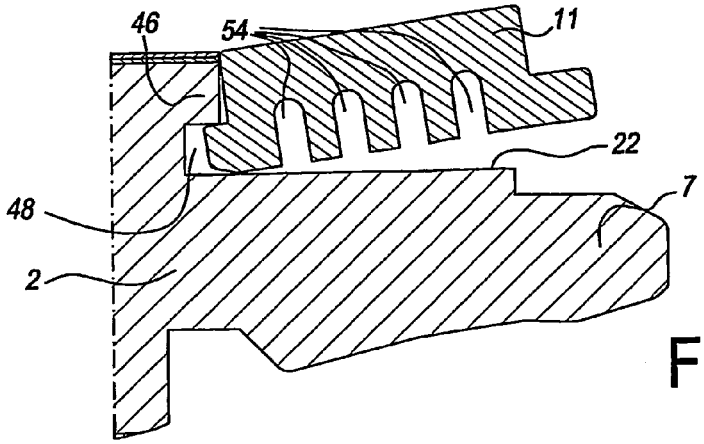
Figure 15:
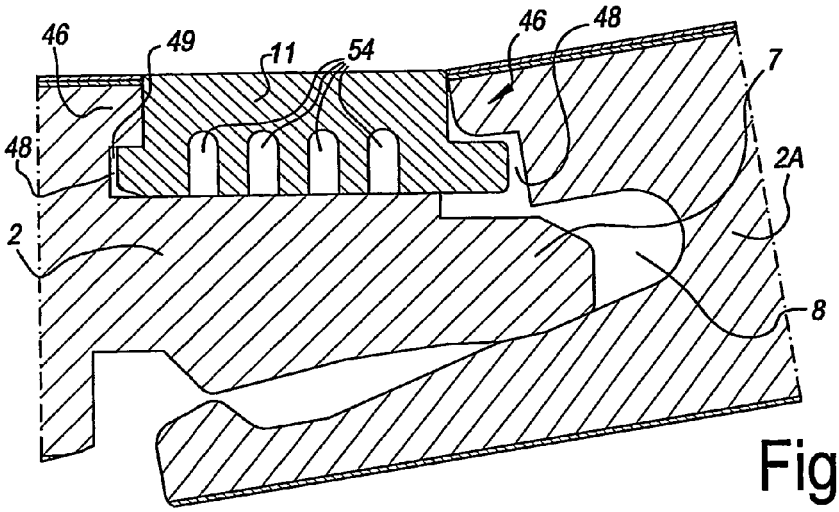

FIGS. 13 to 15 represent how a floor covering 1, as depicted in FIG. 12, can be installed. The technique applied therein also forms an example for the method for forming a floor covering set forth in the introduction. According to this example, the floor panels 2 respectively are laid such that they are directed with the tongue 7 towards a row that still has to be installed. When a new row of floor panels 2A must be installed, first the strip 11 is provided on the tongues of the floor panels 2 of the preceding row, as illustrated in FIG. 14. Thereafter, the floor panels 2A, as illustrated in FIG. 15, are provided with their groove 8 over the tongue 7, as a consequence of which the strip 11 comes into a locked position. Herein, it is advantageous that the strip 11 is provided on an already installed row of floor panels 2 and thus is already situated in a stable final position before the floor panels 2A are coupled to the floor panels 2, which facilitates mounting.

According to a particular characteristic, the strip 11 and the floor panels 2 comprise means in the form of mutually cooperating portions, which provide for, when a strip 11 is provided on a floor panel 2, whereas no subsequent floor panel 2A is coupled thereto, the strip still is retained. An advantage of such means consists in that the strips tends less to become dislodged from the laid-down position during mounting, whereby the mounting of the subsequent floor panels 2A is facilitated.

Figure 16:
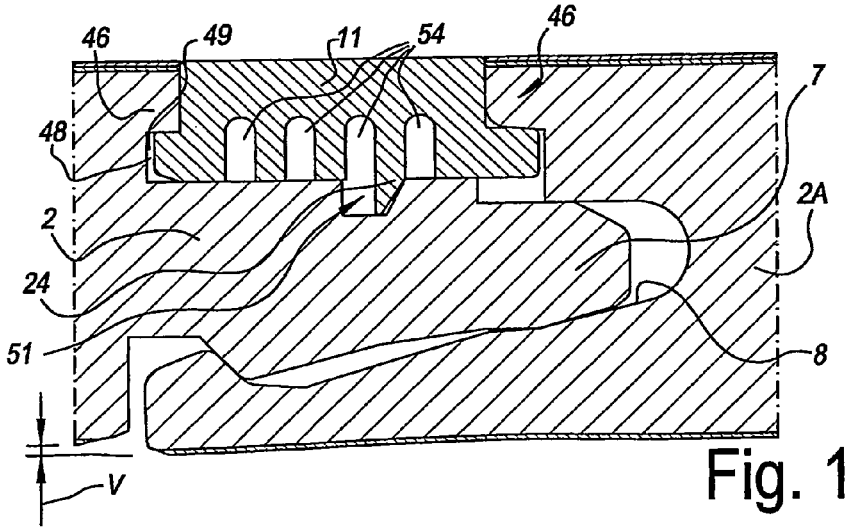
FIG. 16 represents a variant of the portion represented in FIG. 12.
Figure 17:
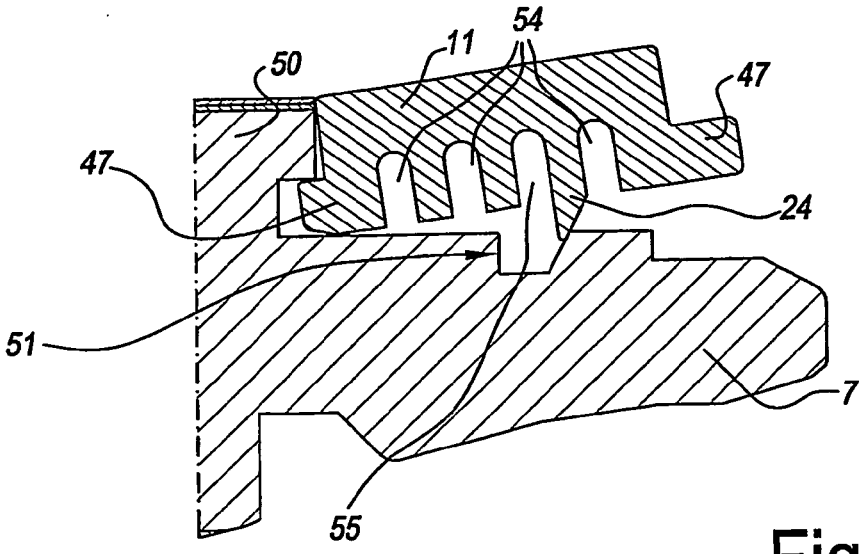
FIG. 17 represents how the strip of FIG. 16 is mounted.

In the embodiment of FIGS. 16 and 17, these means 51 consist of the attachment part 24 fitting into the attachment groove 25 provided to this aim.

Figure 18:
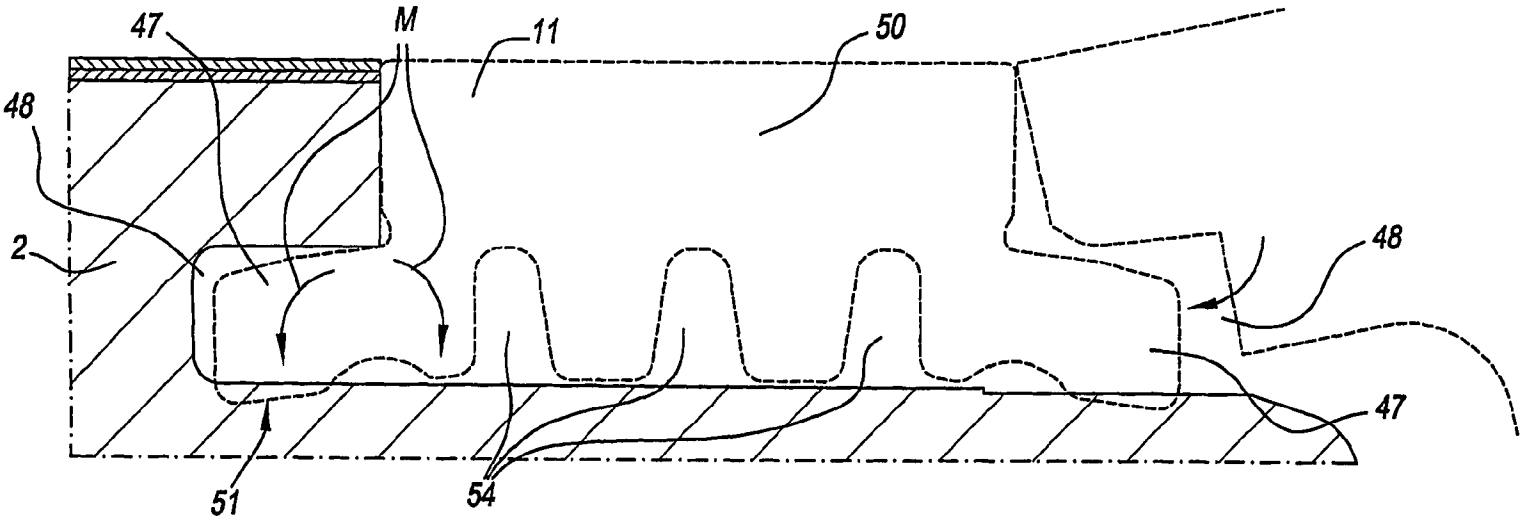
FIG. 18 represents a variant of the portion indicated by F18 in FIG. 12.

In the embodiment of FIG. 18, these means consist of pre-shaped projections 47, of which the left projection 47, in a mounted condition of the strip 11, where the floor panel 2A is not yet present, will provide for that a torsional moment M is created in the strip, by which the strip 11 is pressed onto the support surface 22 and is kept at its place more or less by friction and/or clamping. In FIG. 18, the strip 11 is depicted in free pre-shaped condition, in order to show that there is a certain overlap between the contour of the free strip 11 and the contour of the recess 48, with the consequence that, in effectively mounted condition, a bending will occur in the projection, which then causes a retaining force. As represented, preferably both projections 47 are made in such a manner, such that, irrespective of how the user provides the strip 11 on the tongue 7, always the desired clamping effect is obtained.

Figure 19:
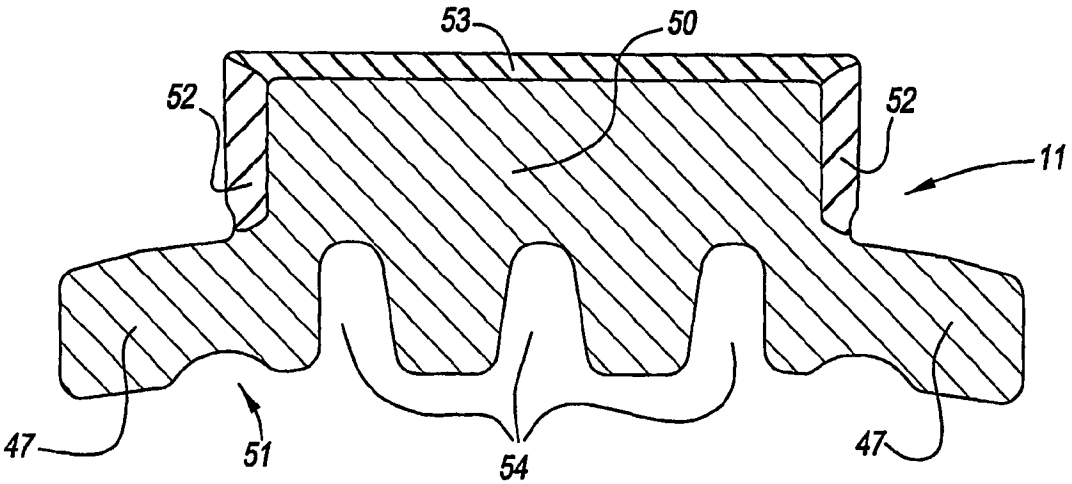
FIG. 19 in cross-section represents another strip according to the invention.

FIG. 19 represents a variant of the strip 11 from FIG. 18, wherein lateral layers 52 and an upper layer 53 of separate materials are applied, for example, by means of co-extrusion. The lateral layers 52, for example, consist of a relatively soft material in order to effect a good sealing, whereas the upper layer 53 consists of a material that is chosen in function of the desired appearance and the desired abrasion resistance, whereas the remaining material is chosen in function of the desired rigidity and strength of the strip.

As represented in FIGS. 12 and 14 to 20, according to the invention a strip 11 can be applied, which, at the bottom side, is provided with one or more recesses 54 extending over a height that is at least ⅓ of the thickness of the strip 11, or at least of the thickness of the basic body of the strip. Such recesses 54 provide for that the lower portion is more resilient than the part 50, as a consequence of which clamping forces are taken up in the majority by the part 50 and the tensioning force contributes optimally to a good sealing at the height of this part 50.

Generally, it is noted that, possibly at least between the sides of the strip 11 and the adjacent sides of the actual floor panels 2, a sealing agent can be provided, which is particularly useful with floor panels with a MDF/HDF core. Such seal may consist, for example, of a varnish, wax or the like, which is provided on all adjacent walls.

Figure 20:
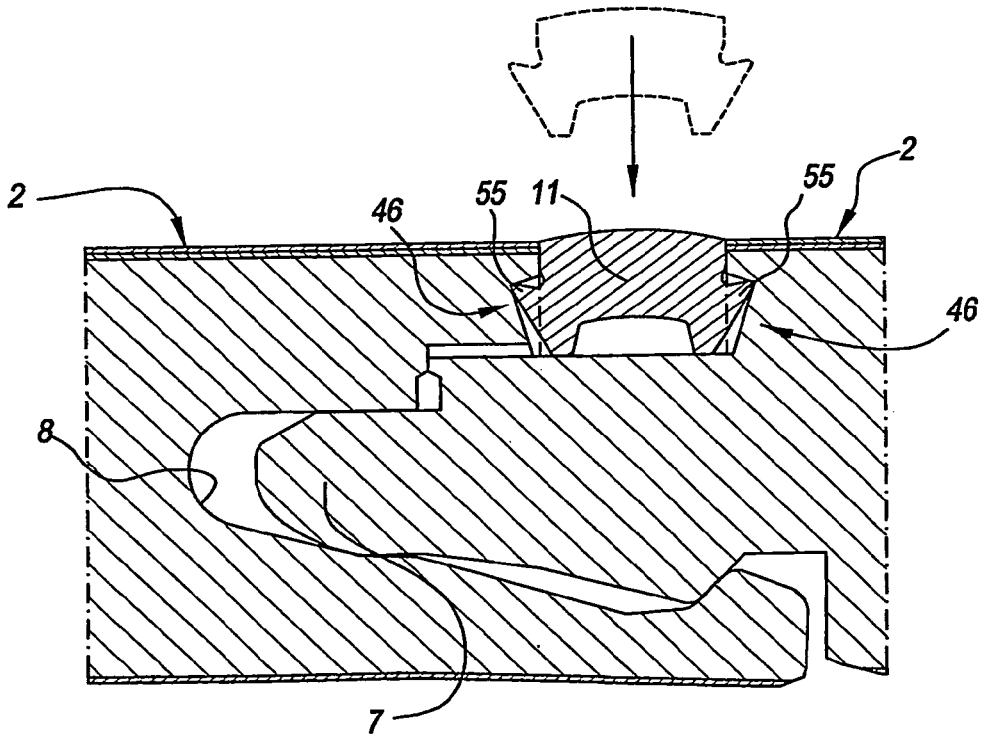
FIG. 20 represents another variant of the invention.

FIG. 20 represents another variant allowing to couple the respective floor panels 2 first to each other, such in any manner, for example, by turning or snapping each floor panel 2 of a subsequent row into a floor panel 2 of the preceding row by means of shifting, after which the strip 11 is firmly pressed into the seat provided to this aim and is held at its place by the projecting edges 55.

It is clear that the invention also relates to methods for realizing a floor covering, wherein according to a first method the seal 14 and/or 17 is provided during the installation of the floor panels, whereas according to a second method one works with floor panels possessing an already factory-applied strip 11 and/or seal 17 of transfer material 41. These methods have already been explained above.

The present invention is in no way limited to the forms of embodiment described by way of example and represented in the figures, on the contrary may such floor covering, floor panels and methods for manufacturing floor panels be realized according to various variants, without leaving the scope of the invention.

So, for example, is it clear that such strip 11 can be provided between either the short as well as the long sides of adjacent floor panels, or between all of the sides. The same is valid for seals 17 with transfer material 41. Also, at both sides of two coupled panels, wherein said sides face each other, strips 11 of transfer material 41 can be provided, wherein in the first case then two strips will rest against each other. When it is described that the strip 11 or the transfer material 41 cooperates with or comes into contact with the actual floor panel, this does not necessarily have to be directly and may take place by means of an intermediate material or additional part.

According to deviating variants of the invention, such strip 11 or transfer material layer will also be employed with floor coverings and floor panels, where the coupling means not necessarily provide for a vertical as well as a horizontal locking.

From the above, it is clear that the first and second aspects of the invention can be combined in one and the same floor panel or floor covering. This is possible by applying the two aspects at two pairs of different sides, respectively, as well as by integrating them into one and the same pair of sides. In the latter case, then two seals 14 and 17 are becoming seated against each other between two adjacent floor panels.

The invention claimed is:

1. Floor covering, comprising floor panels, which, at least at two opposite sides, comprise coupling parts, which, in the coupled condition of two of such floor panels, provide for a vertical as well as for a horizontal locking, wherein in the coupled condition, at least at the location of said two sides of at least two mutually coupled floor panels, a strip is provided in the floor covering, said strip extending up to a visible side of the floor covering;

wherein the strip forms a seal against the penetration of moisture between the floor panels in the coupled condition;

wherein said two opposite sides form a first pair of opposite sides;

wherein the floor panels are rectangular and form a second pair of opposite sides;

wherein a seal is provided also at the second pair of opposite sides when two panels are installed next to each other;

said first pair of opposite sides extending in a first direction, and said second pair of opposite sides extending in a second direction perpendicular to the first pair of opposite sides, the seal having a larger visible width at the first pair of opposite sides extending in the first direction than the visible width of the seal at the second pair of opposite sides extending in the second direction.

2. The floor covering according to claim 1, wherein the floor panels are oblong to provide long sides and other sides; wherein the seal at the long sides is formed by the strip, wherein the seal has a visible width of at least 3 mm; and wherein the seal at the other sides has a visible width that is smaller than 1 mm or is not visible.

3. The floor covering according to claim 1 or 2, wherein the seal at the sides extending in the second direction comprises a sealing mass, sealing layer or sealing tape provided between the floor panels in the coupled condition.

4. Floor covering according to claim 1 or 3, wherein the floor panels comprise laminate panels, said laminate panels comprising a core based on wood and a laminate top layer based on synthetic material, and wherein the strip adjoins the laminate top layer, and forms a seal up to this laminate layer.

5. The floor covering according to claim 1 or 3, wherein the floor covering is arranged as a ship floor or ship deck, wherein the floor panels present between the strips comprise a wood pattern.

6. The floor covering according to claim 1 or 3, wherein at the respective sides between two adjacent floor panels one strip is present, wherein such strip then is either or both coupled to one of the adjacent floor panels and substantially is supported thereby, and, in the installed condition of the floor covering, the strip contacts the edge of the other floor panel.

7. The floor covering according to claim 1 or 3, wherein the strip has a flat basic body extending in substantially a horizontal direction.

8. The floor covering according to claim 1 or 3, wherein the coupling parts comprise a tongue and groove structure and wherein the strip is either or both provided and attached at a side of the respective floor panel that is provided with the tongue.

9. The floor covering according to claim 1 or 3, including attachment means, such that the strip is locked in a vertical direction in such a manner that the strip is prevented from being dislodged from the plane of the floor covering.

10. The floor covering according to claim 1 or 3, wherein the strip and the floor panels comprise mutually cooperating portions, such portions providing that, with a strip provided on a floor panel with no subsequent floor panel being coupled thereto, the strip is retained on the respective floor panel on which it is provided.

11. The floor covering according to claim 1 or 3, wherein the strip is clamped between the floor panels in the coupled condition.

12. The floor covering according to claim 11, wherein the floor panels, at least at the sides where the strip is present, are coupled to each other with a pretension.

13. The floor covering according to claim 1 or 3, wherein the strip comprises synthetic material or rubber.

14. The floor covering according to claim 1 or 3, wherein the strip is extruded.

15. The floor covering according to claim 14, wherein the strip is formed by co-extrusion of two or more materials.

16. The floor covering according to claim 1 or 3, wherein the strip comprises an insertable prefabricated element, which, during the installation of a floor, after coupling together a number of the floor panels, is provided between the floor panels, wherein the floor panels have well-defined lengths, so that the strip extends continuously over a larger length.

17. The floor covering according to claim 1 or 3, wherein the strip comprises an element, which, upon mutually coupling a number of the floor panels to from the floor covering, is taken up between the floor panels and is locked, wherein the floor panels have well-defined lengths, and the strip extends continuously over a larger length.

18. Method for installing a floor covering; said floor covering comprising floor panels and strips; said floor panels having at least two opposite sides being provided with horizontally active and vertically active coupling parts enabling a coupled condition of said floor panels at said opposite sides; said strips extending up to a visible side of the floor covering at said opposite sides in said coupled condition of said floor panels; said floor covering at least comprising two rows of floor panels; wherein said method at least comprises the steps of:

providing said floor panels;

providing one of said strips in the form of a separate element;

installing a first row of said two rows of floor panels; and installing a subsequent second row of said two rows of floor panels by means of floor panels that are coupled to the floor panels of said first row, while mounting said one strip between said first row and said subsequent second row of floor panels;

wherein said floor panels have lengths and said one strip extends over a length that is larger than said lengths of said floor panels;

wherein said vertically active coupling parts comprise a tongue and a groove; wherein said horizontally active coupling parts comprise locking parts; wherein said step of installing said first row comprises laying said floor panels such that said first row of said floor panels is directed with said tongues towards said second row still to be laid; wherein the mounting of said one strip takes place before installing said second row; and wherein the step of mounting of said one strip comprises providing said one strip on said tongues of said floor panels of said first row and thereafter providing the grooves of said floor panels of said second row over the tongues of said floor panels of said first row;

wherein the one strip is automatically vertically locked as a result of providing the grooves of the floor panels of said second row over the tongues of the floor panels of said first row.

19. Floor covering, comprising first and second floor panels, which, at least at two opposite sides, comprise coupling parts, which, in a coupled condition of the first and second floor panels, provide for a vertical as well as for a horizontal locking, wherein in the coupled condition, at least at the location of the two sides of at least two mutually coupled floor panels, a strip is provided in the floor covering between the first and second panels, said strip extending up to a visible side of the floor covering;

wherein said strip in the coupled condition of at least two such panels is vertically locked thereby being prevented from leaving the floor covering in an upwards direction;

wherein the first floor panel has a tongue with an upper surface;

wherein the first panel at the side thereof which comprises the tongue defines a support surface situated higher than the upper side of the tongue, the strip arranged to be supported by the support surface when the first and second floor panels are vertically locked in the coupled condition.

20. Floor covering, comprising first and second floor panels, which, at least at two opposite sides, comprise coupling parts, which, in a coupled condition of the first and second floor panels, provide for a vertical as well as for a horizontal locking, wherein in the coupled condition, at least at the location of the two sides of at least two mutually coupled floor panels, a strip is provided in the floor covering between the first and second panels, said strip extending up to a visible side of the floor covering;

wherein the strip defines at least one bendable pre-shaped projection adapted to create a torsional moment in the strip when the at least one projection bends as it is inserted into a recess formed by the first floor panel when the first and second floor panels are placed in the coupled condition;

wherein said projection is provided at one side of the strip, a second projection being provided at a second opposite side of the strip; and wherein said projections form locking means which in the coupled condition of two of such panels retain the strip from leaving the floor covering.

21. The floor covering according to claim 20, wherein the recess is located above the coupling parts of the first floor panel.

22. The floor covering according to claim 20, wherein the bottom part of the strip defines at least one area of reduced thickness, the at least one area of reduced thickness making the lower portion of the strip more resilient than an upper portion of the strip.

* * * * *